United States Patent [19]

Miyazawa et al.

[11] 4,004,928

[45] Jan. 25, 1977

[54] COLOR PHOTOGRAPHIC MATERIAL

[75] Inventors: Sadayuki Miyazawa; Yoshikazu Takaya, both of Nagaokakyo, Japan

[73] Assignee: Mitsubishi Paper Mills, Ltd., Tokyo, Japan

[22] Filed: Aug. 25, 1975

[21] Appl. No.: 607,546

[30] Foreign Application Priority Data

Aug. 28, 1974 Japan ..... 49-98567
Aug. 29, 1974 Japan ..... 49-98398

[52] U.S. Cl. ..... 96/84 UV; 96/100
[51] Int. Cl.[2] ..... G03C 1/84; G03C 1/40
[58] Field of Search ..... 96/84, 100, 84 UV

[56] References Cited

UNITED STATES PATENTS 3,676,147 7/1972 Boyer et al. ..... 96/140
3,779,765 12/1973 McCrossen et al. ..... 96/100

*Primary Examiner*—Mary F. Kelley
*Attorney, Agent, or Firm*—Cushman, Darby & Cushman

[57] ABSTRACT

Use of the compounds represented by the general formula;

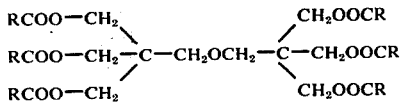

(wherein R represents an alkyl group of 1 – 8 carbon atoms) as a permanent solvent for color coupler or ultraviolet ray absorber in color photographic materials.

9 Claims, No Drawings

COLOR PHOTOGRAPHIC MATERIAL

BACKGROUND OF THE INVENTION

The present invention relates to a color photographic material and more particularly it relates to a color photographic material wherein a nondiffusing oil soluble color coupler is stably dispersed in an aqueous protective colloid layer containing silver halide emulsion in oil-in-water state and stability of color images formed by color development of the coupler is improved.

It has been known in U.S. Pat. No. 2,322,027 (1943) that nondiffusing oil soluble coupler is dissolved in a high boiling point organic solvent such as dibutyl phthalate (DBP) or tricresyl phosphate (TCP), thereafter the solution is emulsified and dispersed in an aqueous protective colloid material such as gelatin in oil-in-water state in the presence of a surfactant by colloid mill or homo mixer and the resultant dispersion is added to an aqueous protective colloid such as gelatin which contains silver halide, whereby the dispersion is introduced into color photographic material in finely dispersed non-crystalline or nearly non-crystalline state.

The high boiling point organic solvents used in said method not only possess direct photographic function, but also are apt to damage permeability of developers and moreover to deteriorate properties of emulsion layer. Therefore, content of these solvents in film layers is desirably as small as possible. Therefore, it is necessary that they have sufficiently high solubility for couplers. Furthermore, practical ratio of coupler and the high boiling point organic solvent is about 1 : 1 – 1 : 3 while solubility of coupler is usually considerably lower than said ratio and so at said ratio the coupler dispersion is generally in supersaturated state. Therefore, it is necessary requirements that not only the solvents have high solubility, but also they are high in supersaturation stability. When these requirements are insufficiently met, extra amount of solvent is required. Thus, thickness of coated film layer is increased to result in increased tendency of curling up of photographic materials, reduction in permeability of developer and color forming efficiency in color development, decrease in sharpness of image due to scattering of light in film layer and brightness of color and increase in production cost.

Other requirements to be possessed by high boiling point organic solvents used for this purpose are that the solvents per se have no color, they have good compatibility with medium incorporated therein, they are inert to other additives in photographic material and treating solutions, they cause no photographic fogging and have no effect on sensitivity and gradation.

Still other requirement is that stability of dye produced by reaction of a coupler with an oxidized color developer against ultraviolet ray and wet heat is high. For stabilizing against ultraviolet ray, selection of the high boiling point organic solvents is useful, but practically sufficient stabilization effect can be obtained by providing a filter layer which uses commonly employed ultraviolet absorbers such as 2-arylbenzotriazole and benzophenone type ultraviolet absorbers. However, stability against humidity and heat depends greatly upon the high boiling point organic solvents used. Thus, search for such organic solvents has been intensively conducted.

Furthermore, as mentioned above, in order to prevent dyes in color images from fading due to ultraviolet ray, ultraviolet ray absorbing filter layer is usually provided and it is well known that 2-aryl-benzotriazole derivatives are particularly effective for this purpose. The 2-aryl-benzotriazole derivatives per se are excellent in light and heat stabilities to cause no decomposition and no undesired coloration. Furthermore, they are colorless and effectively intercept the ultraviolet ray of a spectrum of 300 – 400 nm and effectively transmit a light of more than 400 nm.

As in the case of couplers mentioned hereinbefore, in order to introduce said 2-aryl-benzotriazole derivative into color photographic materials as ultraviolet ray filter layer, conventionally the derivative is dispersed in non-crystalline form as oil-in-water droplets dissolved in a high boiling point organic solvent such as dibutyl phthalate or tricresyl phosphate. Such method is disclosed in Japanese Patent Publications No. 26,178/67 and No. 29,620/69.

The greatest difficulty in introduction of 2-arylbenzotriazole ultraviolet ray absorber into layers of color photographic materials is that said compound is extremely liable to crystallize. Crystallization of 2-arylbenzotriazole derivative in oil droplets brings about troubles such as ununiform coating in production of photographic materials, damage of surface gloss of film or opacification of the film and reduction in absorbing ability of ultraviolet ray as compared with the case where 2-arylbenzotriazole derivative is dispersed in non-crystalline form. This crystallization may occur not only in production of photographic materials, but also in storage of the materials, in treating step such as development and furthermore after lapse of time from the treatment.

The high boiling point organic solvent used herein must high solubility for 2-arylbenzotriazole derivative. If the solubility is insufficient, such disadvantages as explained hereinbefore with reference to the solvent for couplers also occur.

In order to compensate the insufficient solubility and to make the size of the dispersed oil particles finer, low boiling point organic solvents such as ethyl acetate, isopropyl acetate, cyclohexane, etc. may be jointly used as an assistant solvent to attain emulsification and dispersion. However, due to evaporation of the assistant solvent, density of the ultraviolet absorber in the oil particles is increased to cause instabilization of the dispersed particles and to result in easy crystallization.

SUMMARY OF THE INVENTION

It is, therefore, an object of the present invention to improve dispersion stability of dispersed oil droplet particles of coupler contained in color photographic silver halide emulsion.

It is another object of the present invention to improve stability of dye images obtained by color development of coupler against wet heat.

It is another object of the present invention to improve storage stability of dispersed oil colloid particles of 2-arylbenzotriazole derivative ultraviolet ray absorber.

The foregoing objects and others are accomplished in accordance with the present invention by using as a permanent solvent for color coupler and ultraviolet ray absorber a compound represented by the general formula:

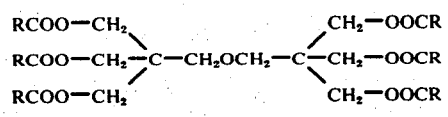

(I)

In the above formula, R represents an alkyl group of 1 – 8 carbon atoms which may be straight or branched chain alkyl group.

The term "permanent solvent" used herein means high boiling point organic solvents which encompass the compounds represented by the general formula (I) and which can be retained in the form of oil droplet particles of solvent containing coupler or ultraviolet ray absorber finely dispersed in oil-in-water state in film layers of color photographic materials.

The permanent solvents used in the present invention may be used alone or in combination of two or more. Furthermore, they may be used in combination with other known high boiling point solvents such as DBP, TCP, etc. Moreover, as an assistant solvent, a low boiling point solvent which can be finally evaporated or removed, for example, the compounds as disclosed in U.S. Pat. Nos. 2,949,360, 2,801,170 and 2,801,171 may be jointly used to accomplish emulsification and dispersion.

The permanent solvents used in the present invention are substantially utterly or nearly colorless and odorless and are markedly low in toxicity.

Result which proves the low toxicity of these compounds is reported in H. W. Garge: Toxicology of Drugs and Chemicals (1969).

The compounds represented by the general formula (I) include those as shown below, but the solvents used in the present invention are not limited to these compounds only.

| Solvents | | R |
|---|---|---|
| Compound | (1) | $-CH_3$ |
| " | (2) | $-CH_2CH_3$ |
| " | (3) | $-(CH_2)_2CH_3$ |
| " | (4) | $-CH(CH_3)_2$ |
| " | (5) | $-(CH_2)_3CH_3$ |
| " | (6) | $-CH_2CH(CH_3)_2$ |
| " | (7) | $-C(CH_3)_3$ |
| " | (8) | $-(CH_2)_4CH_3$ |
| " | (9) | $-(CH_2)_2CH(CH_3)_2$ |
| " | (10) | $-CH_2C(CH_3)_2$ |
| " | (11) | $-C(CH_3)_2CH_2CH_3$ |
| " | (12) | $-(CH_2)_5CH_3$ |
| " | (13) | $-(CH_2)_4CH(CH_3)_2$ |
| " | (14) | $-(CH_2)_6CH_3$ |
| " | (15) | $-CH_2C(CH_2CH_3)CH_2CH_2CH_3$ |
| " | (16) | $-(CH_2)_7CH_3$ |

The permanent solvents as mentioned above may be available from those on the market. However, in accordance with the methods as disclosed in Japanese Patent Publications Nos. 7,359/61 and 17,815/61, they can be prepared as follows: to dipentaerythritol is added a slightly excessive amount of a monocarboxylic acid and esterification is carried out at 200° – 230° C under pressure. The produced water is distilled out and unreacted fatty acid is distilled out and recovered under a high vacuum of about 1 mmHg to obtain a desired ester.

The nondiffusing couplers suitable to be used in the present invention are disclosed in the following U.S. Patents and Japanese Patent Publications.

1. Cyan dye forming couplers; 2,373,293, 2,423,730, 2,801,171, 2,895,826, 2,908,573, 3,046,129, 3,034,892, 3,311,476, 3,253,294, 3,458,315, 3,227,550, 3,476,563, 3,419,390, 3,516,831.
2. Magenta dye forming couplers; 2,600,788, 2,801,171, 2,908,573, 2,983,608, 3,006,759, 3,062,653, 3,152,896, 3,214,437, 3,227,550, 3,227,554, 3,252,924, 3,311,476, 3,408,194, 3,432,521, 3,519,429, 3,419,391.
3. Yellow dye forming couplers; 2,778,658, 2,875,057, 2,908,573, 3,227,550, 3,227,554, 3,227,155, 3,253,924, 3,265,506, 3,369,895, 3,384,657, 3,408,194, 3,415,652, 3,447,928.
4. DIR couplers; 3,779,765, 3,748,141, Japanese Patent Application Laid-Open No. 51943/74.

Besides the above enumerated couplers, in the permanent solvent dispersed in the color photographic layers there may be also contained stabilizers which may be effectively combined with couplers and which are disclosed in U.S. Pat. Nos. 3,432,300 and 3,574,627 and Japanese Patent Publications No. 4738/72, 31256/73, 31625/73, 31626/73 and 32728/73 and color stain preventing agent, color fogging preventing agent, etc. as disclosed in U.S. Pat. Nos. 2,336,327, 2,360,290, 2,403,721, 2,728,659, 3,459,548, 3,287,126, 3,482,971, 2,710,801, 2,816,028, 2,418,613, 2,704,713 and 2,732,330.

Amount of the permanent solvent used in the present invention may be optionally selected depending upon kind and amount of the medium jointly used, but particularly preferably 0.3 – 3 parts by weight per 1 part by weight of the color coupler or 2-arylbenzotriazole derivative. The permanent solvent is suitably contained in an amount of 0.12 – 4.8 g/m² in the color photographic layers and allowed to be present in a proportion of 0.1 – 1.0 part by weight per 1 part by weight of binder (solid matter) such as gelatin.

Examples of 2-arylbenzotriazole derivatives used in the present invention are disclosed, for example, in U.S. Pat. Nos. 3,189,615 and 3,253,921, Japanese Patent Publication No. 763/73 and Japanese Applications Laid-Open No. 1021/72 and No. 10537/72.

The following are preferred examples thereof, but the present invention is not limited to these compounds only.

1. 2-(2′-hydroxy-5′-methylphenyl)benzotriazole
2. 2-(2′-hydroxy-5′-t-butylphenyl)-5-chlorobenzotriazole
3. 2-(2′-hydroxy-5′-amylphenyl)benzotriazole
4. 2-(2′-hydroxy-3′,5′-di-t-butylphenyl)benzotriazole
5. 2-(2′-hydroxy-3′,5′-di-t-amylphenyl)benzotriazole Color stain preventing agents and color fogging preventing agents, etc. may also be contained in the permanent solvent of the present invention as mentioned before.

The invention will be further illustrated by the following Examples. It should be understood, however, the invention is not to be construed as limited by the Examples.

EXAMPLE 1

In 6g of α-benzoyl-5-[γ-(2,4-ditertiary-amylphenoxy)butylamide]-2-chloroacetanilide were dissolved 6g of di-n-butyl phthalate (DBP) and 12 ml of ethyl acetate. The resultant solution was added to 100 ml of 5% aqueous gelatin solution containing 0.4g of sodium lauryl-benzenesulfonate and the mixture was subjected to colloid mill to carry out emulsification and dispersion . . . . dispersion (A).

The above procedure was repeated using the following permanent solvents in place of DBP.

Dipentaerythritolhexabutyrate ester (Compound 3) . . . . dispersion (B)

Dipentaerythritolhexaoctanoate ester (compound 14) . . . . dispersion (C)

These dispersions (A) – (C) were kept at 40° C over water bath and after lapse of time, dispersion stability of oil droplets was observed by optical microscope. The results are shown in Table 1.

Table 1

| Dispersion | Solvent | Immediately after dispersion | After lapse of 5 hours | After lapse of 24 hours |
|---|---|---|---|---|
| (A) | DBP (comparison) | Good | Crystal was separated | Crystal was separated |
| (B) | Compound 3 | Good | Good | Crystal was separated |
| (C) | Compound 14 | Good | Good | Crystal was separated |

EXAMPLE 2

Each of the dispersions (A) – (C) prepared in Example 1 was mixed with gelatin-silver halide emulsion and this was coated on a support in the following concentration.

Silver — 0.65 g/m²
Gelatin — 2.0 g/m²
Coupler — 0.52 g/m²

These materials were subjected to blue light exposure through a step wedge to produce yellow step images. Thereafter, these were allowed to stand in a dark place of 50° C, 80% RH for 4 weeks. Then, fade density $\Delta D_{0.5}$ of the portion of density 0.5, fade density $\Delta D_{1.0}$ of the portion of density 1.0 and fade density $\Delta D_{1.5}$ of the portion of density 1.5 were measured to obtain the results as shown in Table 2.

Table 2

| | Solvent | $\Delta D_{0.5}$ | $\Delta D_{1.0}$ | $\Delta D_{1.5}$ |
|---|---|---|---|---|
| 1 | DBP (comparison) | 0.08 | 0.13 | 0.20 |
| 2 | Compound (3) | 0.05 | 0.07 | 0.11 |
| 3 | Compound (14) | 0.05 | 0.06 | 0.10 |

EXAMPLE 3

The same tests as described in Example 1 were carried out on a magenta coupler, 1-(2,4,6-trichlorophenyl)-3- 3-[α-(2,4-di-t-amylphenoxy)-butyl amide]-4-butoxybenzamide -5-pyrazolone to examine dispersion stability. For comparison, TCP (tricresyl phosphate), EPEG (ethylphthalylethyl glycolate) and TB (tri-n-butyrin) were used besides DBP.

The results are shown in Table 3.

Table 3

| Dispersion | Solvent | Immediately after dispersion | After lapse of 5 hours | After lapse of 24 hours | After lapse of 3 days |
|---|---|---|---|---|---|
| (D) | DBP (comparison) | Good | Good | Good | Crystal was separated |
| (E) | TCP (comparison) | Good | Good | Good | Crystal was separated |
| (F) | EPEG (comparison) | Good | Good | Good | Crystal was separated |
| (G) | TB (comparison) | Good | Good | Crystal was separated | Crystal was separated |
| (H) | Compound (3) | Good | Good | Good | Good |
| (I) | Compound (14) | Good | Good | Good | Good |

EXAMPLE 4

Using the dispersions (D) – (I) in Example 3 the same tests as in Example 2 were repeated to measure fade density of magenta images. The results are shown in Table 4. Coating amounts on the support were as follows:

Silver — 0.37 g/m²
Gelatin — 1.8 g/m²
Coupler — 0.43 g/m²

Table 4

| | Solvent | $\Delta D_{0.5}$ | $\Delta D_{1.0}$ | $\Delta D_{1.5}$ |
|---|---|---|---|---|
| 1 | DBP (Comparison) | 0.11 | 0.14 | 0.28 |
| 2 | TCP (Comparison) | 0.10 | 0.14 | 0.25 |
| 3 | EPEG (Comparison) | 0.08 | 0.11 | 0.20 |
| 4 | TB (Comparison) | 0.12 | 0.16 | 0.31 |
| 5 | Compound (3) | 0.06 | 0.09 | 0.15 |
| 6 | Compound (14) | 0.05 | 0.07 | 0.13 |

EXAMPLE 5

The same tests as in Example 1 were carried out using cyan coupler 2-[α-(2,4-ditertiary-amylphenoxy)-butylamide]-4,6-dichloro-5-methylphenol to examine dispersion stability. The results are shown in Table 5.

Table 5

| Dispersion | Solvent | Immediately after dispersion | After lapse of 5 hours | After lapse of 24 hours | After lapse of 3 days |
|---|---|---|---|---|---|
| (J) | DBP (Comparison) | Good | Good | Good | Crystal was separated |
| (K) | Compound (3) | Good | Good | Good | Good |

Table 5 -continued

| Dispersion | Solvent | Immediately after dispersion | After lapse of 5 hours | After lapse of 24 hours | After lapse of 3 days |
|---|---|---|---|---|---|
| (L) | Compound (14) | Good | Good | Good | Good |

EXAMPLE 6

The same tests as in Example 2 were repeated using the dispersions (J) – (L) in Example 5 to measure fade density of cyan images. The results are shown in Table 6. Coating amounts on a support were as follows:

Silver — 0.23 g/m²
Gelatin — 1.8 g/m²
Coupler — 0.36 g/m²

Table 6

| | Solvent | $\Delta D_{0.5}$ | $\Delta D_{1.0}$ | $\Delta D_{1.5}$ |
|---|---|---|---|---|
| 1 | DBP (Comparison) | 0.00 | 0.02 | 0.03 |
| 2 | Compound (3) | 0.00 | 0.00 | 0.01 |
| 3 | Compound (14) | 0.00 | 0.00 | 0.01 |

EXAMPLE 7

In 6g of di-n-butyl phthalate (DBP) were dissolved 6g of 2-(2'-hydroxy-3',5'-di-t-butylphenyl)-benzotriazole together with 12 ml of ethyl acetate and 0.4g of sodium laurylbenzenesulfonate. The resultant solution was added to 50 ml of 10% aqueous solution of gelatin and the mixture was subjected to colloid mill to emulsify and disperse for 20 minutes . . . . dispersion (M).

The above procedure was repeated using the following permanent solvents in place of DBP.

Dipentaerythritolhexabutyrate ester (compound 3) . . . . dispersion (N)

Dipentaerythritolhexaoctanoate ester (compound 14) . . . . dispersion (O).

These dispersions (M) – (O) were kept at 40° C over a water bath and after lapse of time, dispersion stability of the oil droplet particles was observed by an optical microscope. The results are shown in Table 7.

EXAMPLE 8

Each of the dispersions (M) – (O) prepared in the same manner as in Example 7 was added to 120 ml of 5% aqueous solution of gelatin and this was coated on a photographic triacetate film support in an amount of about 22 g/m² and dried.

Transparency of these samples were measured immediately after coating and after being allowed to stand under the conditions of 50° C and 80% RH for 2 days. The results are shown in Table 8. As control, transmission of triacetate film was taken as 100%.

Table 8

| | Solvent | Transmission (%) Immediately after coating | After 2 days, 50° C 80 % RH |
|---|---|---|---|
| Sample 1 | DBP | 88 | 78 |
| Sample 2 | Compound (3) | 94 | 92 |
| Sample 3 | Compound (14) | 96 | 92 |

In the case of Sample 1, crystal was separated on surface of film immediately after coating and haze occurred while samples 2 and 3 maintained transparency even after 2 days under the conditions of 50° C and 80% RH.

EXAMPLE 9

Dispersions (P) – (R) were prepared in the same manner as in Example 7 except that 2-(2'-hydroxy-3',-5'-di-t-amylphenyl)benzotriazole was used as ultraviolet ray absorber and the dispersions were kept at 40° C over a water bath. Dispersion stability after lapse of time is shown in Table 9.

Table 9

| Dispersion | Solvent | Immediately after dispersion | After lapse of 5 hours | After lapse of 24 hours | After lapse of 2 days | After lapse of 4 days |
|---|---|---|---|---|---|---|
| (P) | DBP (Comparison) | Good | Good | Good | Crystallization | Crystallization |
| (Q) | Compound (3) | Good | Good | Good | Good | Good |
| (R) | Compound (14) | Good | Good | Good | Good | Good |

Table 7

| Dispersion | Solvent | Immediately after dispersion | After lapse of 1 hour | After lapse of 5 hours | After lapse of 24 hours | After lapse of 2 days |
|---|---|---|---|---|---|---|
| (M) | DBP (Comparison) | Good | Crystallization | Crystallization | Crystallization | Crystallization |
| (N) | Compound (3) | Good | Good | Good | Good | Crystallization |
| (O) | Compound (14) | Good | Good | Good | Good | Crystalization |

In the case of DBP, crystal began to be separated after lapse of 1 hour while in the case of the compounds (3) and (14) of the present invention the dispersions were stable even after lapse of 24 hours.

In the case of DBP, crystallization occurred after 2 days from dispersion while compounds (3) and (14) of the present invention did not change even after lapse of 4 days.

EXAMPLE 10

Each of dispersions (P) – (R) of Example 3 was added to 120 ml of 5% aqueous solution of gelatin and each of the mixture was coated in an amount of about 22 g/m² on a photographic polyethylene coated paper subjected to electron bombardment and then dried.

Gloss of the film surface of these samples was measured by a gloss meter manufactured by Nihon Denshoku K.K. immediately after coating and after allowed to stand for 2 days under the conditions of 50° C and 80% RH. The results are shown in Table 10.

Table 10

| | Solvent | Gloss (%) Immediately after coating | Gloss (%) After 2 days under 50° C, 80 % RH |
|---|---|---|---|
| Sample 4 | DBP (Comparison) | 70 | 52 |
| Sample 5 | Compound (3) | 84 | 78 |
| Sample 6 | Compound (14) | 85 | 78 |

The results show that the solvents of the present invention are especially excellent in storage stability of the dispersed particles and do not cause reduction in surface gloss.

What is claimed is:

1. A color photographic material having a silver halide emulsion layer and a filter layer, there being present either one or both of (1) a non-diffusing oil-soluble color coupler in said silver halide emulsion layer; or (2) an ultraviolet ray absorber in said layer on a support, there being present in at least one of said silver halide emulsion layer and said layer at least one compound of the formula:

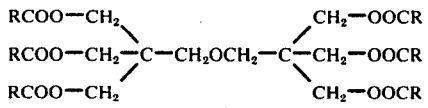

(I)

wherein R is an alkyl group of 1 – 8 carbon atoms as a permanent solvent for said color coupler or said ultraviolet ray absorber.

2. A color photographic material according to claim 1, wherein the permanent solvent containing a color coupler or ultraviolet ray absorber is dispersed in oil-in-water state.

3. A color photographic material according to claim 1, wherein the color coupler is selected from ketomethylene yellow dye forming coupler, 5-pyrazolone magenta dye forming coupler and phenolic or α-naphtholic cyan dye forming coupler.

4. A color photographic material according to claim 1, wherein the ultraviolet ray absorber is a 2-aryl-benzotriazole derivative.

5. A color photographic material according to claim 3, wherein the amount of the permanent solvent is 0.3 – 3 parts by weight per 1 part by weight of the color coupler.

6. A color photographic material according to claim 4, wherein the amount of the permanent solvent is 0.3 – 3 parts by weight per 1 part by weight the ultraviolet ray absorber.

7. A color photographic material according to claim 1, wherein the permanent solvent is dipentaerythritol hexaoctanoate ester or dipentaerythritolhexabutyrate ester.

8. A color photographic material according to claim 1, wherein the color coupler and the permanent solvent are present in silver halide emulsion layers.

9. A color photographic material according to claim 1, including protective layers and wherein the ultraviolet ray absorber and the permanent solvent are present in said protective layers.

* * * * *